US006952642B1

(12) United States Patent
Cowen

(10) Patent No.: US 6,952,642 B1
(45) Date of Patent: Oct. 4, 2005

(54) DEVICE AND METHOD FOR ENGINE CONTROL

(76) Inventor: Robert Andrew Cowen, 4836 Lincolnshire Ct., Broadview Heights, OH (US) 44147

( * ) Notice: Subject to any disclaimer, the term of this patent is extended or adjusted under 35 U.S.C. 154(b) by 92 days.

(21) Appl. No.: 10/722,911

(22) Filed: Nov. 28, 2003

Related U.S. Application Data

(63) Continuation-in-part of application No. 10/305,043, filed on Nov. 26, 2002, now Pat. No. 6,760,659.

(51) Int. Cl.[7] ..... G06G 7/70

(52) U.S. Cl. ..... 701/113; 701/112; 701/114; 123/399; 123/361; 123/339.23; 123/367; 700/287

(58) Field of Search ..... 701/113, 112, 115, 701/102, 103, 101, 29, 54, 53, 1; 700/287, 700/170, 180; 123/399, 41.07, 41.13, 339.23, 123/361, 367, 462

(56) References Cited

U.S. PATENT DOCUMENTS 4,368,705 A 1/1983 Stevenson et al. ..... 123/357
5,377,112 A 12/1994 Brown, Jr. et al. ..... 364/431.12
5,506,777 A 4/1996 Skrbina et al. ..... 701/102
6,073,610 A * 6/2000 Matsumoto et al. ..... 123/396
6,622,080 B2 * 9/2003 Yang et al. ..... 701/103
6,704,643 B1 * 3/2004 Suhre et al. ..... 701/115
2002/0046742 A1 4/2002 Hagari ..... 123/568.22

* cited by examiner

*Primary Examiner*—Tony M. Argenbright
*Assistant Examiner*—Johnny H. Hoang
(74) *Attorney, Agent, or Firm*—Harpman & Harpman

(57) ABSTRACT

A microprocessor base interengageable engine generator set control and profile throttle control devices that provide directional communication and control via common J1939 protocol of electronic engine control units. Such engine and throttle control units provide critical engine information and control using manufacturers proprietary codes that are readable by the interface engine control or independent throttle control input parameters. Engine commands are issued by programmable software and operational input in response to information received and analyzed thereby for ultimate control for known preset parameters in multiple manual and non-fully automatic modes of the profile throttle control device.

10 Claims, 5 Drawing Sheets

DEVICE AND METHOD FOR ENGINE CONTROL

This is a continuation in part patent application of Ser. No. 10/305,043, filed Nov. 26, 2002 now U.S. Pat. No. 6,760, 659.

BACKGROUND OF THE INVENTION

1. Technical Field

This invention relates to electronic engine control devices that are used on a wide variety of industrial engines, specifically power generators that require engine and generator performance parameters to be monitored and provide required operational power output in relation to the effective load.

2. Description of Prior Art

Prior art energy control devices have been directed towards independent engine controls utilizing a number of independent remote sensors in a master slave orientation. See for example U.S. Pat. Nos. 4,368,705, 5,377,112, 5,506, 777 and U.S. Patent Publication 2002/0040742 A1.

In U.S. Pat. No. 4,368,705 an engine control system is disclosed in which an electronic system controls engine performance parameters based on timing maps that define different modes of diesel engine operation.

U.S. Pat. No. 5,377,112 illustrates a method for diagnosing an engine using computer based models in which current engine operation parameters are determined and compared with a preset optimum operational settings and adjusted to match the preprogrammed requirements.

U.S. Pat. No. 5,506,777 describes an electronic engine control having a central processing unit and an analog to digital converter that receives analog engine performance data and converts same into digital output for processing by a central CPU device.

In U.S. Patent Publication 2002/0046742 A1 discloses an electronic control device for engines and method of controlling by comparing actual performance data with desired outcome by controlling the EGR valve in view thereof.

SUMMARY OF THE INVENTION

An electronic engine controller utilizing a controller network interface for direct bi-directional communication between electronic engine control unit (ECU) and the electronic engine controller utilizing the can bus J1939 protocol to monitor and control the engine directly. The electronic engine controller uses programmable software to determine operational parameters and institute electronic control commands to the ECU in a pre-determined response operational framework. An electronic throttle control device integrated into the engine controller program for multiple engine throttle control parameters including engine start, stop and programmable throttle (speed configuration manipulation) in multiple programmable requirements.

DESCRIPTION OF THE PREFERRED EMBODIMENT

Figure 1:
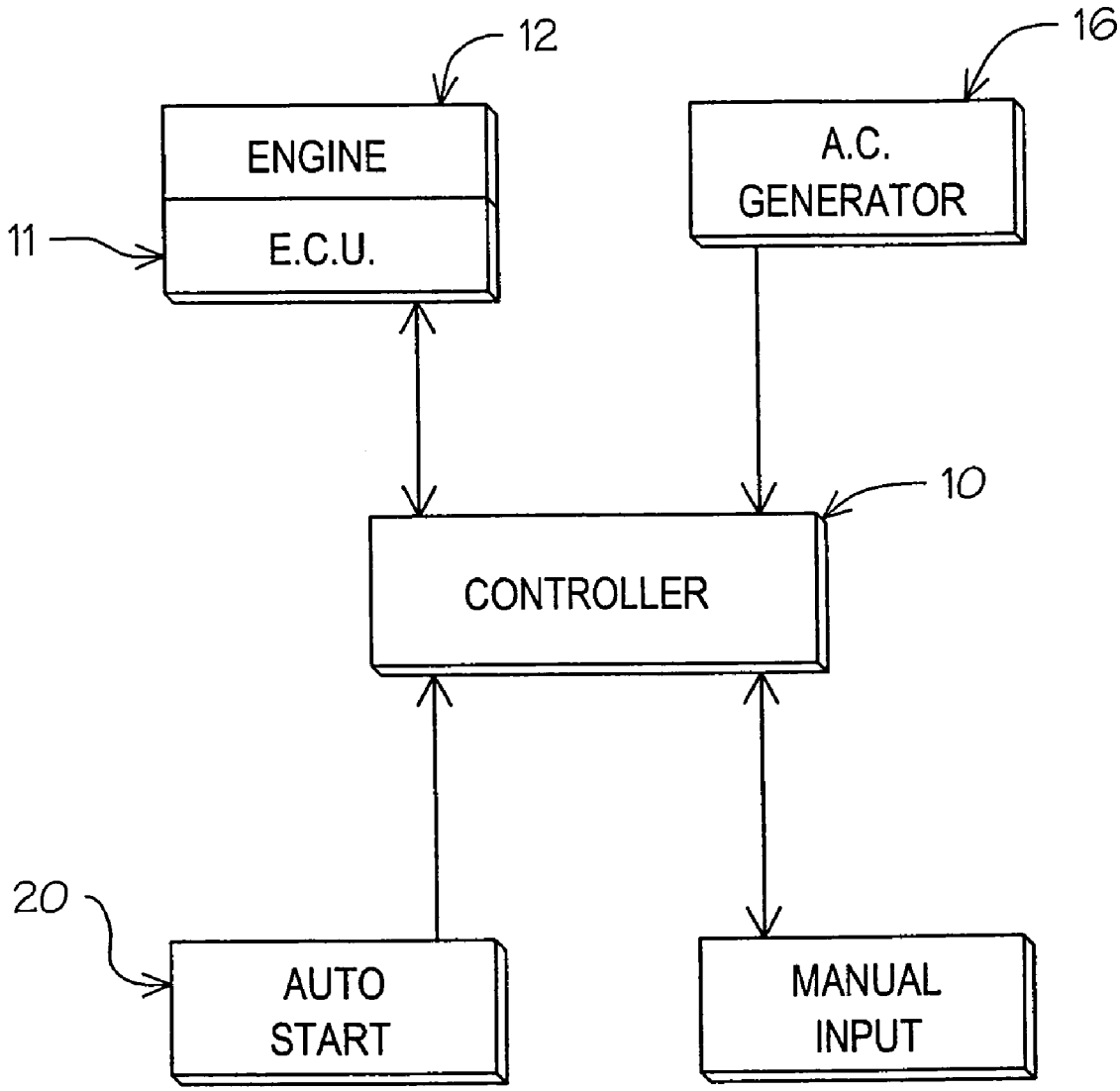
FIG. 1 is a graphic block flow diagram of the basic controller interface and relation of same with operational aspects to be controlled.
Figure 2:
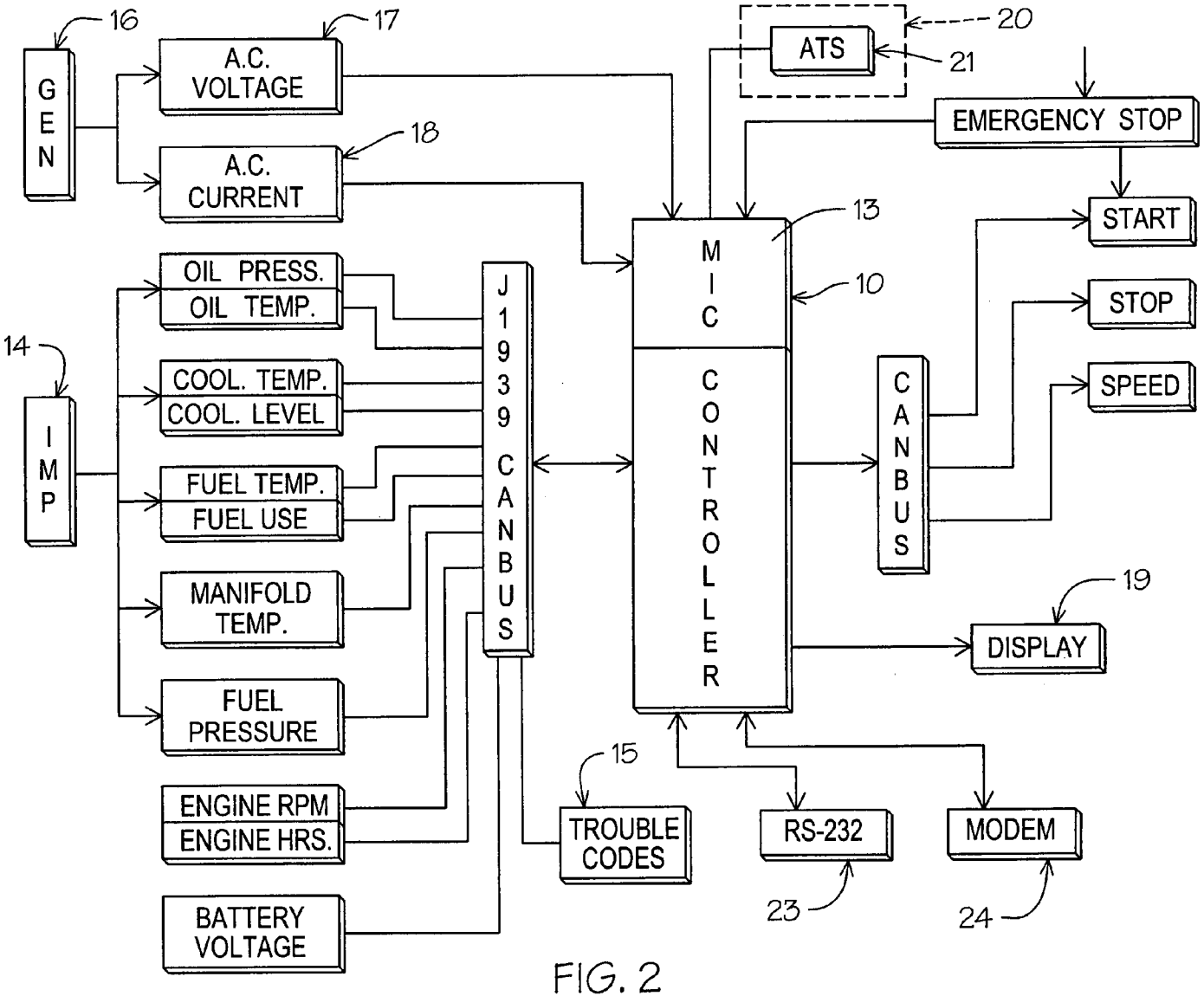
FIG. 2 is a graphic block flow diagram of a specific operational input monitor and output control actions.

Referring to FIGS. 1 and 2 of the drawings, an electronic engine controller 10 of the invention can be seen in communication with an electronic control unit (ECU) 11 associated with an engine 12. The (ECU) 11 is found on industrial engines of certain displacements to manage engine performance to meet government emission (EPA) standards. Such (ECU's) utilize a control area network (CANBUS) using a J1939 communication protocol characterized by digital addressable message protocol allowing communication between multiple (ECU's) as will be understood by those skilled in the art. Accordingly, engine manufacturers provide (ECU's) having their own proprietary control configurations and electronic codes enabled by software protocol applications. The engine controller 10 of the invention uses a microprocessor 13 and custom software application to read the control information input (IMP) generally indicated at 14 generated by the (ECU's) via the (CANBUS). The engine information inputs 14 provide critical engine performance and operation information including, but not limited to engine oil pressure, oil temperature, manifold temperature, coolant temperature, fuel pressure, fuel temperature, fuel use rates, engine RPM, engine hours, battery voltage as well as calculated percent of torque, percent of effective load to relative engine RPM and throttle position.

Other information gathered includes engine manufacturers protection operation safety parameters to indicate out of preset tolerance conditions indicated by electronic trouble codes 15.

In the example chosen for illustration, an engine 12 and a power generator 16 referred to as a (generator set) application is used in which the generator operation information is also gathered by the engine controller 10 of the invention including measuring specific performance output criteria of the generator such as AC voltage 17 and AC current 18 and calculating related power factors there from. The engine controller 10 establishes communication with (ECU) and will request status information continuously as specific data rates such as total engine hours, for example.

A display 19 is provided to communicate the engine's operational statistics so gathered and calculated given the continuous information request as noted.

The display 19 therefore will be updated with the most current information providing a real time informational access portal.

By utilization of custom software the engine controller 10 of the invention will issue commands to the (ECU) 11 to control critical operational functions such as and not limited to engine operational speed by increasing or decreasing engine speed and engine start and stop commands.

Figure 6:
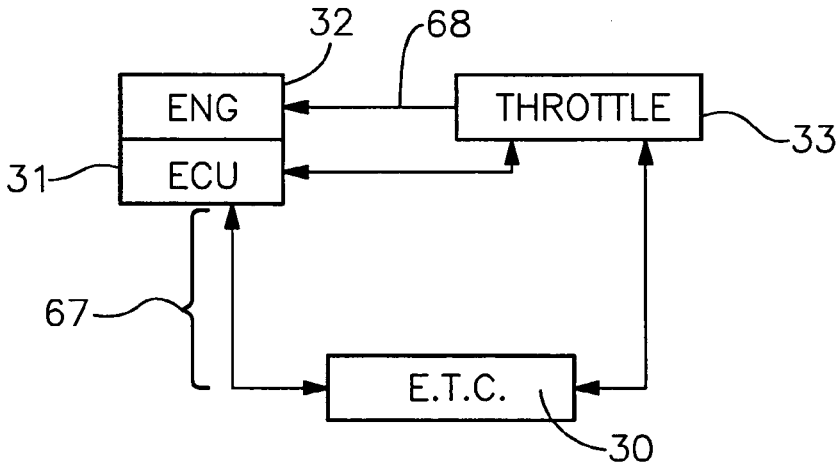
FIG. 6 is a block flow diagram of the profile throttle controller in a controller application.
Figure 7:
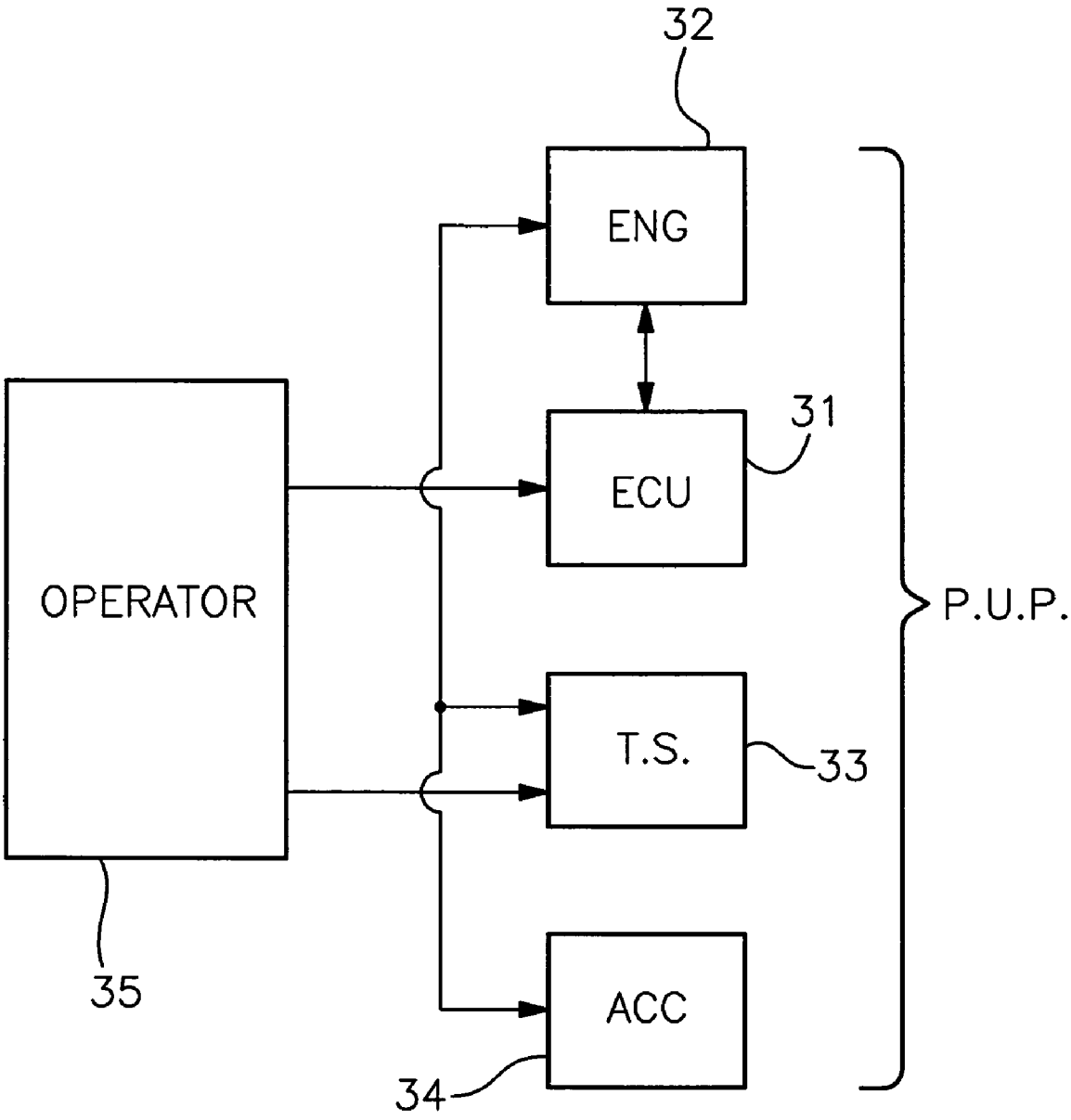
FIG. 7 is a block flow diagram of the profile throttle controller.

Referring to FIG. 6 of the drawings, an electronic engine throttle control (ETC) 30 of the invention can be seen in communication with an alternate engine control unit 31 on an alternate industrial engine 32. The ETC 30 can be integrated into the engine control unit 31 which as set forth is part of a typical so-called "power unit package" (P.U.P.)

as seen in FIG. 7 of the drawings, offered by engine manufacturers including the engine unit 32, the engine control unit 31, and engine throttle system 33 and some type of engine accessory 34 which can be any working mechanism to be driven by the engine unit (ENG) 32 as will be well understood by those skilled in the art.

Typically, in such "power unit packages" operation requires an operator 35 to start the (ENG) 32 utilizing the engine control unit (ECU) 31 and adjust the engine speed by the throttle system (TS) 33. In such systems, an auto start and stop sequence can be achieved, but not independent automated variable throttle control which is needed in different engine use applications to be described in greater detail hereinafter.

Figure 3:
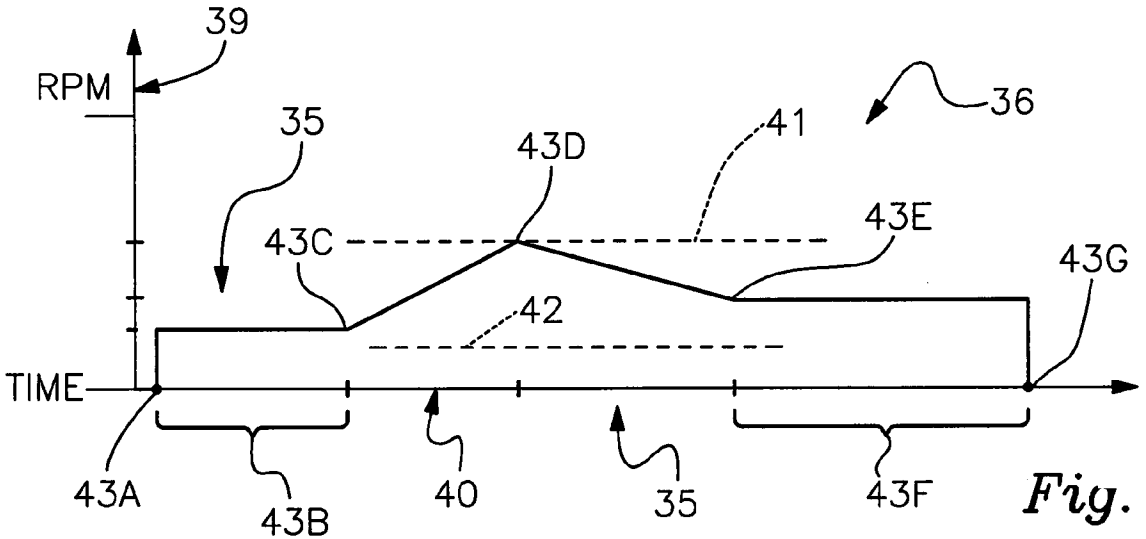
FIG. 3 is a graphic control diagram of engine speed to time function in a manual mode control of a profile throttle.
Figure 4:
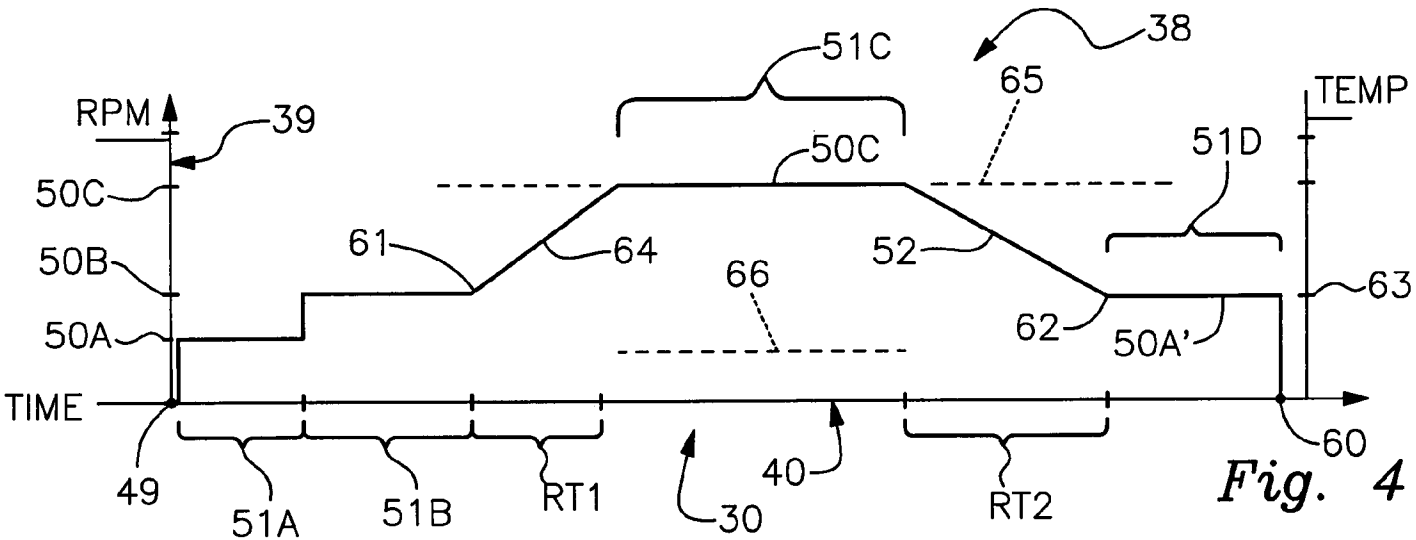
FIG. 4 is a graphic control diagram of engine speed to time function in a fully automatic mode.
Figure 5:
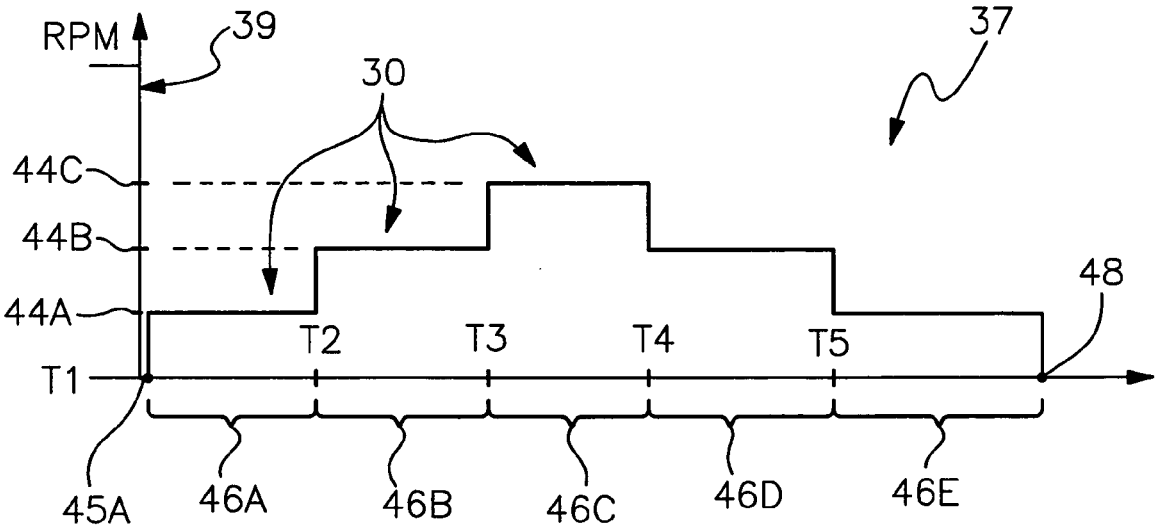
FIG. 5 is a graphic control diagram of engine speed to time function in a manual/automatic mode.

Referring now to FIGS. 3–5 of the drawings, multiple throttle control parameters available at use of the throttle control 30 of the invention are illustrated including a manual throttle mode 36, manual automatic throttle mode 37 and fully automatic throttle mode 38. Referring now to FIG. 3 of the drawings, the manual mode 36 example is illustrated wherein engine speed RPM 39 is vertically graphed and a time line duration at 40 is horizontally graphed. Prescribed upper engine RPM and lower engine RPM limits 41 and 42 representatively are illustrated with multiple operator input control actions are sequence illustrated along the time duration line 40 as follows.

Operator, not shown, starts the engine at 43A with the engine idle duration indicated at 43B. Operator ramps (speeds up) the engine RPM at 43C reaching the upper RPM limit 41. The operator then ramps down the engine at 43D to a selective operating engine RPM noted at 43E for a final time duration indicated at 43F. After the prescribed run time duration, the engine shuts off at 43G.

Utilizing the throttle control 30 of the invention in the manual/automatic mode 37 can be seen as illustrated in FIG. 5 of the drawings in which the engine RPM 39 is controlled by a combination of preprogrammed RPM setting 44A, 44B and 44C and operative sequential selection thereof. In this example, the engine has been preprogrammed to run only at the three RPM settings 43A, 43B and 43C. The operator can select any one of the RPM settings in the time sequence chosen to achieve the desired engine performance requirement as follows.

Operator starts the engine at 45A and the RPM setting 44A is obtained defining a warm-up time duration at 46A. The operator then ramps up the engine RPM to the preprogrammed RPM setting 44B for the time duration 46B. Further ramping of the RPM is then instituted to the RPM setting 44C. The operator in this illustration determines the time durations indicated at 46A, 46B, 46C, 46D and 46E in which the RPM settings are then correspondingly ramped down for the time durations 46D and 46E through the preprogrammed RPM setting 44B and 44A with engine shut down indicated at 48.

Referring to FIG. 4 of the drawings, the fully automatic mode 38 of the throttle control 30 of the invention can be seen wherein the throttle control 30 institutes all engine controls with an automatic engine start at 49 which may determine, for example, by a preprogrammed external variable input such as an excess fluid level in a pump situation, not shown. Multiple preprogrammed engine RPM's 50A, 50B and 50C, specifically idle, warm-up, and target RPM are reached and maintained for preprogrammed time durations indicated at 51A, 51B, 51C and 51D. Intervening ramp up RPM's and ramp down RPM's RT1 and RT2 respectively occur between the warm-up RPM 50B and target RPM 50C to the cool down RPM 50A' before auto engine shut off occurs at 60.

Engine temperature criteria illustrated at speed point 61 and corresponding point 62 are utilized to determine the effective duration of a preprogrammed RPM being maintained such as for warm-up RPM 50B and cool down RPM 50A'.

In these examples, both the warm-up time 51B and a warm-up temperature 63 are utilized with the warm-up temperature 63 over-riding the preprogrammed warm-up time 51B so that the engine 32 may ramp up at 64 to the target RPM 50C once the preset temperature 63 has been met.

Other engine preprogrammed parameters are available such as maximum RPM indicated by dotted lines 65, minimum RPM's by dotted lines 66.

Ramp time is the known or desired time programmed to achieve the target RPM 50C in either the warm-up RPM 50B or conversely the cool down RPM 50A' from the target feed duration illustrated at 51C.

The engine run cycle is terminated automatically after the program or actual preprogrammed temperature the engine has been achieved. Based on the foregoing, a number of variations on the throttle control 30 of the invention will be evident under the prescribed manual, manual/automatic, and fully automatic modes 36, 37 and 38 respectively as follows.

In manual mode, vernier throttle in which the engine speed is controlled over the entire range of preprogrammed setting with the restricted preset low and high RPM limits.

A multi-mode state throttle control condition in which the operator, as noted, uses specific preset engine speed characteristics from a choice of single or multiple preselect engine speed. The engine therefore will only operate within the selected speeds.

Manual operation input is required to select which speed range will be used and transition there between will be operator imputable by manual controls, not shown.

Referring back now to FIG. 6 of the drawings, the profile throttle control system 30 can be interfaced directly with the engine 32 in two primary ways utilizing torque speed control 67 or direct external engine throttle control at 68. Torque speed control uses the J-1939 cam bus protocol manipulating the engine 32's RPM through the existing manufacturers ECU 31 by software commands. Alternately, the external throttle control inputs on the engine's ECU which the signal increases or decreases the engine's speed in response thereto.

As noted, in a generator application (Gen Set) the engine controller will provide via the (CANBUS) protocol programmable generator protection controls related to voltage parameters such as over voltage, and under voltage; over current, and over frequency and under frequency.

The engine controller 10 combines i.e. integrated the hereinbefore described engine monitoring and control response obtained from the engine controller with analogous analog generator monitoring and protection systems. The (ECU) 10 can also provide automatic start 20 generator set control applicable with (CANBUS) J1939 engine 12 (ECU) 11 protocol.

The auto start 20 feature is enabled via the engine controller 10 which allows starting the (Gen Set) from a remote start command input. Typically this input is generated by an automatic transfer switch ATS 21, but can be from any switch configuration with a ground in communication with the system. This feature provides for unattended automatic starting, monitoring and protection of the (Gen Set) as hereinbefore described.

It will be evident from the above description that the engine controller 10 primary operational goal is to gather specific engine operational parameters 14 supplied by the (ECU) 11 without the requirement of remote communication to individual sensors as has been required in the past. By providing bi-directional communication utilizing the J1939 protocol on the (CANBUS) information so gathered can be acted upon using the pre-programmed set and performance parameters to optimize control protection and efficiency of the (Gen Set) system.

Remote communication portals 23 and 24 utilize an RS-232 input for data control commands along with a telecommunication modem to effect remote access to the engine controller 10 of the invention.

An emergency stop can be instituted if as pre-programmed operational parameters of the system is outside of normal operation criteria.

It will be evident from the above description that by utilizing the engine controller 10 and unique profile throttle control 30 of the invention that a new synergistic combination of total engine control can be achieved. By the multi-faceted explicit control of engine speed with the engine controller's 10 parameter of monitoring and control a unique combination of overall engine control has been achieved.

It will thus be seen that a new and novel electronic engine controller 10 for a (Gen Set) utilizing a control network interface for bi-directional communication between an electronic engine control unit 11 and the controller 10 utilizing the (CANBUS) J1939 protocol and a profile throttle controller 30 has been illustrated and described and it will be apparent to those skilled in the art that various changes and modifications may be made thereto without departing from the spirit of the invention.

Therefore I claim:

1. An electronic engine throttle controller for controlling industrial internal combustion engines RPM in multiple engine use configuration comprises;

a microprocessor base profile throttle control apparatus in communication with the engine, said profile throttle control apparatus including, multiple engine throttle control parameter sequences, said control parameter sequences including a manual mode configuration, a manual automatic mode configuration, and a fully automatic mode configuration, means for programming said electronic engine throttle control for said selective throttle control parameter sequences and engine thermal programmables.

2. The electronic engine throttle control set forth in claim 1 wherein said throttle control apparatus communicates with said engine comprises, integrated interfacing with an engine controller on said engine.

3. The electronic engine throttle control set forth in claim 1 wherein said throttle control apparatus in communication with said engine further comprises, direct communication with an engine throttle control on said engine.

4. The electronic engine throttle control set forth in claim 1 wherein said manual mode control parameter sequences comprise, a manual engine start and stop, manual engine throttle ramping up and down, manual selection of engine throttle operation, settings and selective programmable upper and lower engine RPM limits by said engine throttle control.

5. The electronic engine throttle control of claim 1 wherein said manual automatic control parameter sequences comprises, a manual engine start and stop, multiple preprogrammed engine throttle settings, and multiple manual engine throttle ramping inputs by which said preprogrammed engine throttle settings are activated.

6. The electronic engine throttle control set forth in claim 1 wherein said automatic control parameters sequences comprises, preprogrammed automatic engine starts and stops, preprogrammed engine throttle ramping up and down, and preprogrammed target engine operational RPM.

7. The electronic engine throttle control set forth in claim 6 wherein said preprogrammed engine throttle ramping up and ramping down further comprises, throttle warm-up RPM and cool down RPM.

8. The electronic engine throttle control set forth in claim 7 wherein said preprogrammed engine throttle ramping up and ramping down further comprises, engine throttle RPM ramping up to said target engine operational RPM, and engine throttle RPM ramping down to said engine cool down preset RPM.

9. The electronic engine throttle control set forth in claim 1 wherein said engine's thermal parameters comprises, preprogrammed engine, operational temperatures for said warm-up engine RPM and said cool down engine RPM.

10. The electronic engine throttle control set forth in claim 2 wherein said integral interfacing of said throttle control apparatus with the engine controller on said engine comprises, utilizing a high speed J1939 communication protocol.

* * * * *